US007070458B2

(12) United States Patent
Axenböck et al.

(10) Patent No.: US 7,070,458 B2
(45) Date of Patent: Jul. 4, 2006

(54) SPRING-LOADED CONTACT CONNECTOR

(75) Inventors: Josef Axenböck, Glonn (DE); Peter Auner, München (DE); Frank Heidenreich, Wastenberg (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 10/889,142

(22) Filed: Jul. 13, 2004

(65) Prior Publication Data

US 2005/0048848 A1 Mar. 3, 2005

(30) Foreign Application Priority Data

Jul. 16, 2003 (DE) ..... 103 32 325

(51) Int. Cl.
*H01R 13/24* (2006.01)

(52) U.S. Cl. ..... 439/700; 439/272; 439/886

(58) Field of Classification Search ..... 439/700, 439/272, 556, 886
See application file for complete search history.

(56) References Cited

U.S. PATENT DOCUMENTS 4,138,604 A * 2/1979 Harmsen et al. ..... 200/267
5,248,259 A * 9/1993 Naito et al. ..... 439/34
5,490,797 A * 2/1996 Durgin ..... 439/310
5,908,334 A * 6/1999 Chen et al. ..... 439/824
5,980,288 A * 11/1999 Jarvis ..... 439/188
2005/0037651 A1 2/2005 Axenbock et al.

FOREIGN PATENT DOCUMENTS

| | | |
|---|---|---|
| DE | 23 08 316 | 9/1973 |
| DE | 35 36 142 A1 | 4/1987 |
| EP | 1 102 360 A1 | 5/2001 |
| EP | 1 150 393 A2 | 10/2001 |

* cited by examiner

*Primary Examiner*—Truc Nguyen
(74) *Attorney, Agent, or Firm*—Finnegan, Henderson, Farabow, Garrett & Dunner, L.L.P.

(57) ABSTRACT

The present invention relates to a spring-loaded contact connector comprising two joinable connector members of which at least a first connector member comprises a plurality of spring-loaded contact pins that are supported in an axially displaceable manner in the connector member against a restoring force, wherein the first connector member comprises a connection area for establishing a firm electrical connection, and the connection area includes a compensating means for the axial displacement path of the spring-loaded contact pins

17 Claims, 3 Drawing Sheets

SPRING-LOADED CONTACT CONNECTOR

BACKGROUND OF THE INVENTION

The present invention relates to a spring-loaded contact connector comprising two joinable connector members of which at least a first connector member comprises a plurality of spring-loaded contact pins that are supported in an axially displaceable manner in the connector member against a restoring force.

Such spring-loaded contact connectors are quite stable even under adverse ambient conditions and are e.g. used in audio and communications engineering by the police and armed forces, but also for medical applications. The connector members of the spring-loaded contact connector are quite tight with respect to water and under atmospheric influences—also in the non-joined state. In such generic connectors, the number of the contacts in the two connector members depends on the respectively intended use. With standard applications at least two spring-loaded contact pins are provided. In most types only the contacts of one connector member are designed as spring-loaded contact pins, whereas in some types the contacts on both connector members are designed as spring-loaded contact pins. The contacts of the two connector members are opposite to one another in the respective plug surfaces of the connector members. Thanks to their construction spring-loaded contact connectors cannot cause short-circuiting between the contacts of the connector members during the plugging operation.

Thanks to the axially displaceable spring-loaded contact pins, which due to the restoring force in joined connector members press against the associated contact of the other connector member, a reliable electrical connection is established. Said connection technique has become accepted in many fields of application due to its operational reliability. With such generic spring-loaded contact connectors, there is no need for long and fixed contact pins that project beyond the contact plane of the housing body of the connector members in the joined state and may easily twist or break off during use To establish a reliable contact in a joined state, the spring-loaded contact pins in the non-joined state slightly project beyond the contact plane of the connector member and are pressed by the contacts of the other connector member against the restoring force into the associated connector member when the two connector members are joined. Hence, the spring-loaded contact connectors ensure a highly reliable contact connection together with high resistance to shock and vibration.

DE 23 08 316 A1 discloses electrical connectors which are detachably locked by a bayonet lock and provided with butt contacts. The butt contacts are arranged in an axially displaceable manner in a connector half against the resilient force of a compression spring, the axially movable part of the butt contact, which is designed at one end as a sleeve, sliding over the rigid connection member of the butt contact that is provided with a pin. This telescopic compensation means may be impaired in its operability, especially upon penetration of dirt and moisture during operation, which might also lead to failure of the movement mechanism.

Apart from their resistance under rough ambient conditions, which is high on the whole, spring-loaded contact connectors also show a high reliability of the contact system in case of concussions, vibrations and extreme temperatures, which makes them interesting for many applications. Unfortunately, the complicated construction, which is due to the function, entails a troublesome production and high manufacturing costs, which limits the use of such connectors for applications where high demands are made on reliability.

It is therefore the object of the present invention to reduce the production efforts and the manufacturing costs of generic spring-loaded contact connectors by way of a simple construction, the operability thereof being the same or even improved.

This object is achieved according to the invention for a generic spring-loaded contact connector of the above-mentioned type in that the first connector member comprises a connection area for establishing a firm electrical connection, the connection area including a compensating means for the axial displacement path of the spring-loaded contact pins.

SUMMARY OF THE INVENTION

The compensating means compensates for the axial displacement path of the spring-loaded contact pins, thereby ensuring the function of the spring-loaded contact connector and the repeatability of the joining operation. In comparison with conventional compensating means, this arrangement permits a much simpler construction of the spring-loaded contact connector and thus a reduction of the production efforts.

Advantageously, the compensating means may comprise a cavity and the spring-loaded contact pins may be connected in the connection area to flexible connection lines that are movable in the cavity, compensating the axial displacement path of the spring-loaded contact pins. This permits a simple and inexpensive compensation of the axial displacement path of the spring-loaded contact pins, the spring-loaded contact pins, including the connection to the flexible connection lines, being moved axially. The cavity is preferably formed by the housing walls of the connector member, the cavity being normally filled with air, but other media are also possible that allow for a compensation of the axial displacement path.

To permit a simple construction of the spring-loaded contact connectors, the spring-loaded contact pins are designed as rigid units. So far the spring-loaded contact pins have been designed as telescopic units, at least one axially movable member and one member fixedly anchored in the housing cooperating such that one member designed as a bushing and one member of the spring-loaded contact pin designed as a pin can be telescoped into one another. A spring means required for resetting the spring-loaded contact pins can be supported on the members of the spring-loaded contact pins that can be telescoped into one another. Especially in combination with a compensating means arranged in the connection area of the first connector member for the axial displacement path, the spring-loaded contact pins which are designed as rigid units permit a much simpler construction of the spring-loaded contact connectors.

For a further reduction of the components needed for producing the spring-loaded contact connectors, the spring-loaded contact pins may be designed as one part. This permits a faster assembly and thus less assembling costs.

In a preferred variant, the spring-loaded contact pins are made from an electrically conductive material, particularly a copper-zinc alloy, and have a corrosion-resistant surface coating, especially of gold. Such spring-loaded contact pins have very low contact resistances and show a permanently high contact reliability also in the case of small voltages and currents. This ensures high operational reliability also under extreme or corrosive ambient conditions.

A simple and inexpensive constructional solution for providing the restoring force is made possible by the measure that the restoring force can be applied by a spring means, especially a compression spring.

Another advantage is that according to a variant of the invention the connector members comprise contact surfaces and guide means, the guide means being designed such that when the connector members are joined two opposite contact surfaces perform a relative wiping movement with respect to one another. Short circuiting between the contacts of the connector members is prevented by the guide means during the joining operation of the connector members. The relative wiping movement between two opposite contact surfaces effects a cleaning of the contact surfaces due to the friction existing between said surfaces, whereby the contact reliability of the connector is increased.

In a variant, the spring-loaded contact connector comprises a bayonet lock Even under adverse ambient conditions the bayonet lock ensures a high functional reliability of the locking mechanism, which is especially demanded for military or off-short applications.

In a further variant, the spring-loaded contact connector comprises a screw type connection. Connectors with a screw type connection permit a reliable and understandably complete closing of the lock and are used especially in fields where a reliable contact connection is important, for instance in medical, communications or aerospace engineering.

According to an advantageous variation, the spring-loaded contact pins are surrounded in portions by a seal which seals the spring-loaded contact pins with respect to the surroundings. This seal prevents dirt and moisture from penetrating into the area of the spring-loaded contact mechanism.

In an expedient embodiment, the seal is made watertight up to an overpressure of 1 bar. The connector members in a non-joined state are thus also watertight under water up to a water depth of 10 m. This design is also adequate for protecting the connector members with respect to simple cleaning methods.

Advantageously, the slide seal is made watertight up to an overpressure of more than 5 bar, preferably more than 10 bar. On the one hand, this protects the open connector members from intensive cleaning by high pressure and, on the other hand, effects a sealing against penetrating water up to water depths of more than 50 m, or more than 100 m.

To achieve a high sealing effect between the spring-loaded contact pins and the slide seal, the seal may be designed as a bellows seal. Bellows seals are normally constructionally connected to the spring-loaded contact pins and follow the axial movement of the spring-loaded contact pins, thereby achieving a particularly high sealing effect.

In a further variant, the seal is designed as a slide seal and the spring-loaded contact pins are guided in a relatively displaceable manner in the slide seal so that the spring-loaded contact pins slide along the slide seal in sealed fashion when the connector members are joined. The configuration of the seal as a stationary slide seal permits the sealing of the spring-loaded contact mechanism of the first connector member with a single, substantially flat, seal. The slide seal can seal the spring-loaded contact mechanism over the whole displacement path of the spring-loaded contact pins against the penetration of water and other substances from the surroundings. Apart from a saving of costs for the seal, less efforts have to be taken during assembly of the connector members owing to the slide seal.

Preferably, the slide seal can be produced together with at least a part of the first connector member in a two-component injection molding method. Said production method reduces the numbers of the individual parts needed for the assembly of the spring-loaded contact connector. The two-component injection molding method has the effect that the slide seal can be connected to the jointly produced part of the first connector member, whereby moisture is prevented from penetrating between the slide seal and the simultaneously injected part.

In a variant of the invention, the slide seal is made from a thermoplastic elastomer (TPE). Thermoplastic elastomers can be easily processed, so that they are particularly suited for injection molding processes. The elastic properties, the dimensional stability and the resistance to wear of thermoplastic elastomers are also good, which permits a high and lasting sealing effect.

According to a modification the first connector member comprises a contact element which includes the slide seal and the spring-loaded contact pins and is designed to be usable for both spring-loaded contact connectors with a bayonet lock and spring-loaded contact connectors with a screw type connection. Such a contact element having the spring-loaded contact mechanism permits a free selection of the lock mechanism independently of the contact element. The contact element may be designed as an insert which may equally be used in housings with different lock mechanisms. Such a construction permits the use of the same components for different series. The increased number of the individual components permits a reduction of the component costs.

To guide the spring-loaded contact pins in a safe manner in the contact element, the contact element may further be provided at the connection side and for the establishment of a firm electrical connection with a support plate in which the spring-loaded contact pins are guided in a relatively displaceable manner towards the support plate through the support plate, and the support plate serves to support a spring means which applies the restoring force of the spring-loaded contact pins. Due to the mounting of the support plate, the spring-loaded contact pins are already held during assembly, also in the area of the connection side, with just a slight play in their position. Moreover, the guidance of the spring-loaded contact pins in the support plate enhances the functional reliability of the spring-loaded contact connector as well. With the support of the spring means for resetting the spring-loaded contact pins the support plate assumes a further function apart from the function of guiding the spring-loaded contact pins, whereby the necessary number of components is reduced.

BRIEF DESCRIPTION OF THE DRAWINGS

An embodiment of the present invention will now be explained in detail with reference to the attached drawing, in which.

DETAILED DESCRIPTION OF THE INVENTION

Figure 1:
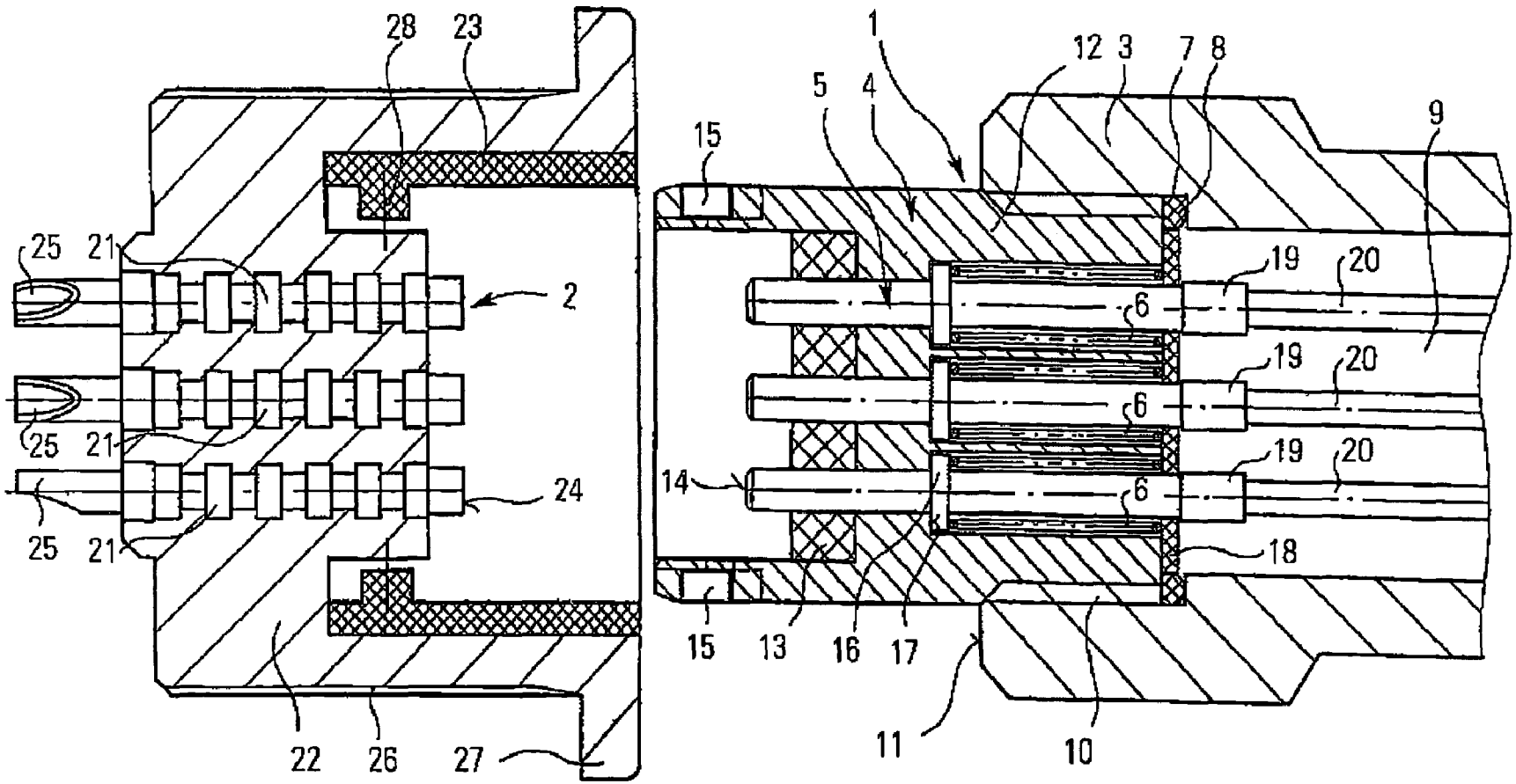
FIG. 1 is a sectional view of a spring-loaded contact connector with bayonet lock in a non-joined state.

FIG. 1 is a schematic view showing an inventive spring-loaded contact connector composed of two joinable connector members 1, 2, in the non-joined state. The first connector member 1, which is shown at the right side of FIG. 1, is designed as a plug and the connector member 2, which is shown at the left side of FIG. 1, as a flange socket. Said connector members 1, 2 can be joined and locked by means of a bayonet lock.

The first connector member 1, which is designed as a plug, consists of a contact element 4 arranged in a plug housing 3, in which integral cylindrical spring-loaded contact pins 5 are arranged in an axially displaceable manner against the restoring force of compression springs 6. The plug housing 3 comprises an inner surrounding groove 7 in which a sealing ring 8 is arranged for sealing the interior 9. The contact element 4 is connected to the plug housing 3, especially screwed or glued, in a connection area 10 which is arranged between the surrounding groove 7 and the face 11 of the plug housing 3 oriented towards the second connector member 2. The contact element 4 consists of a cylindrical guide body 12 which is designed as an annularly surrounding web at the plug side of the contact element 4 which faces the connector member 2. The annularly surrounding web of the guide body 12 is provided on its outside with a plurality of bayonet tracks 15 which first extend in axial and then in radial direction relative to the contact element 4 and which serve to join and lock the connector members 1, 2. A disk-like slide seal 13 is positioned between the annularly surrounding web and is in contact with the guide body 12 on its side face and at the back side facing away from the plug side. Spring-loaded contact pins 5 are coaxially arranged inside the guide body 12, the spring-loaded contact pins 5 being passed through the slide seal 13 and each spring-loaded contact pin 5 being individually movable in the guide body 12. The spring-loaded contact pins 5 project at the plug side beyond the slide seal 13 and comprise contact surfaces 14 at the front side Furthermore, the spring-loaded contact pins 5 are provided in their central portion with annularly surrounding abutment shoulders 15 which rest on corresponding abutment surfaces 17 in the guide body 12 and limit the projection of the spring-loaded contact pins 5. The compression springs 6 are coaxially arranged around the spring-loaded contact pins 5 at the back side of the abutment shoulders 16. The compression springs 6, which are preferably made from stainless spring steel, are supported on a holding plate 18 at the contact side of the contact element 6 that faces away from the plug side, the holding plate being mounted on the guide body 12. The spring-loaded contact pins 5 are guided through the holding plate 18 into the interior 9 of the plug housing 3 and are provided in the interior 9 with connection sleeves 19. The connection sleeves 19 are connected to connecting wires 20 for establishing an electrical contact, especially by way of a solder or crimp connection. On the spring-loaded contact pins 5, the slide seal 13 seals the inner part of the contact element 5 with guide body 12 and compression springs 6 as well as the interior 9 of the plug housing 3 against environmental influences.

Instead of the slide seal shown in FIG. 1, it is equally possible to use a bellows seal that is constructionally connected to the spring-loaded contact pins 5, usually through an annularly surrounding groove, and follows the axial movement of the spring-loaded contact pins.

The connector member 2, which is designed as a flange socket, comprises a plurality of contact pins 21 which are cast or injected into an insulating body 22, preferably of polybutylene terephthalate (PBT) with a 30% glass fiber amount, and a bayonet ring, also made from glass fiber-reinforced PBT. At the plug side of the flange socket facing the connector member 1, the contact pins 21 project from the insulating body 22 with contact surfaces 24 at the front side that during joining are brought into contact with the contact surfaces 14 of the spring-loaded contact pins 5 of the plug. The contact pins 21 are made essentially cylindrical, with small and large diameters alternating in step-like fashion in the insulating body 22 for improving the anchorage of the contact pins 21 in the insulating body 22 and for ensuring the tightness between contact pins 21 and insulating body 22. At the connection side of the flange socket that is opposite to the plug side, the contact pins 21 terminate in connection sleeves 25. The insulating body 22 is provided on its outer circumference with a thread 26 and with an outwardly directed fastening flange 27 which is arranged at the plug side, the interior region of the insulating body 22 with the contact pins 21 being recessed with respect to the fastening flange 27. The flange socket can be sealingly mounted via the thread 26 and the fastening flange 27 in a bore or a housing. The bayonet ring 23 is, inserted into the insulating body 22 which is designed at the plug side as an open cylindrical hollow body. The bayonet ring 23 comprises a plurality of inwardly directed locking pins 28 which cooperate with the bayonet tracks 15 in the guide body 12 for joining and locking the two connector members 1, 2.

Figure 2:
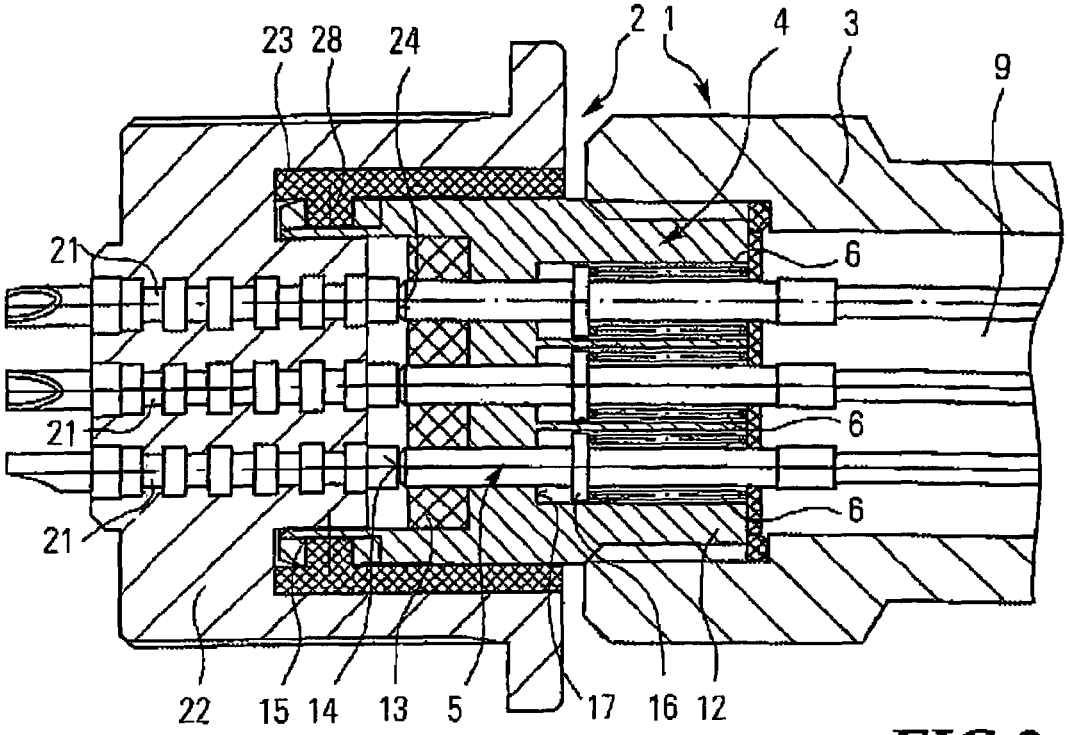
FIG. 2 shows the spring-loaded contact connector of FIG. 1 in a joined state.

FIG. 2 shows the two connector members 1, 2 of FIG. 1 in a joined state. The contact element 4 of the plug is here inserted into the hollow cylindrical region of the flange socket, the locking pins 28 of the bayonet insert 23 engaging into the bayonet tracks 15 of the guide body 12. The contact surfaces 24 of the contact pins that are firmly connected to the insulating body 22 are in contact with the contact surface 14 of the spring-loaded contact pins 5 which are shifted against the restoring force of the compression springs 6 axially towards the interior 9 of the housing 3. Furthermore, the ends of the spring-loaded contact pins 5 at the plug side project from the slide seal 13. The abutment shoulders 16 of the spring-loaded contact pins 5 have lifted from the abutment surfaces 17 formed in the guide body 12 due to the joining of the two connector members 1, 2.

Figure 3:
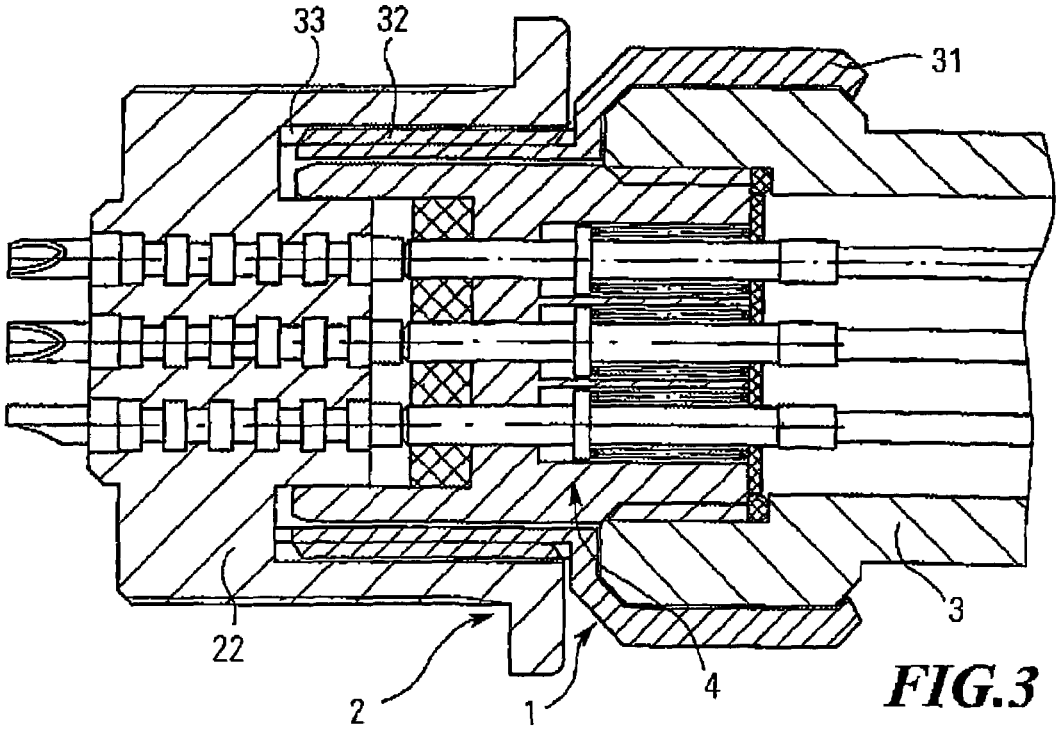
FIG. 3 is a sectional view of a spring-loaded contact connector with screw-type connection in a joined state.

FIG. 3 shows a further embodiment of the spring-loaded contact connector of the invention in the joined state, the connection being realized by a screw type connection in this embodiment. The first connector member 1, which is designed as a plug, comprises a locking ring 31 which is movably arranged on the plug housing 3 and is radially rotatable around the plug housing 3 and the contact element 4, but cannot be displaced in axial direction. The locking ring 31 covers the whole part of the contact element 4 projecting axially from the plug housing 3, said part of the locking ring 31 being provided with an external thread section 32. The external thread section 32 engages into an internal thread 33 for joining and locking the connector members 1, 2, the internal thread being formed on the inside of that part of the insulating body 22 that is designed as a hollow cylinder. In this embodiment, the connector member 2 which is designed as a flange socket is constructionally identical, except for the internal thread 33, with the connector member 2 which is shown in FIG. 2 and provided with bayonet insert 23.

Figure 4:
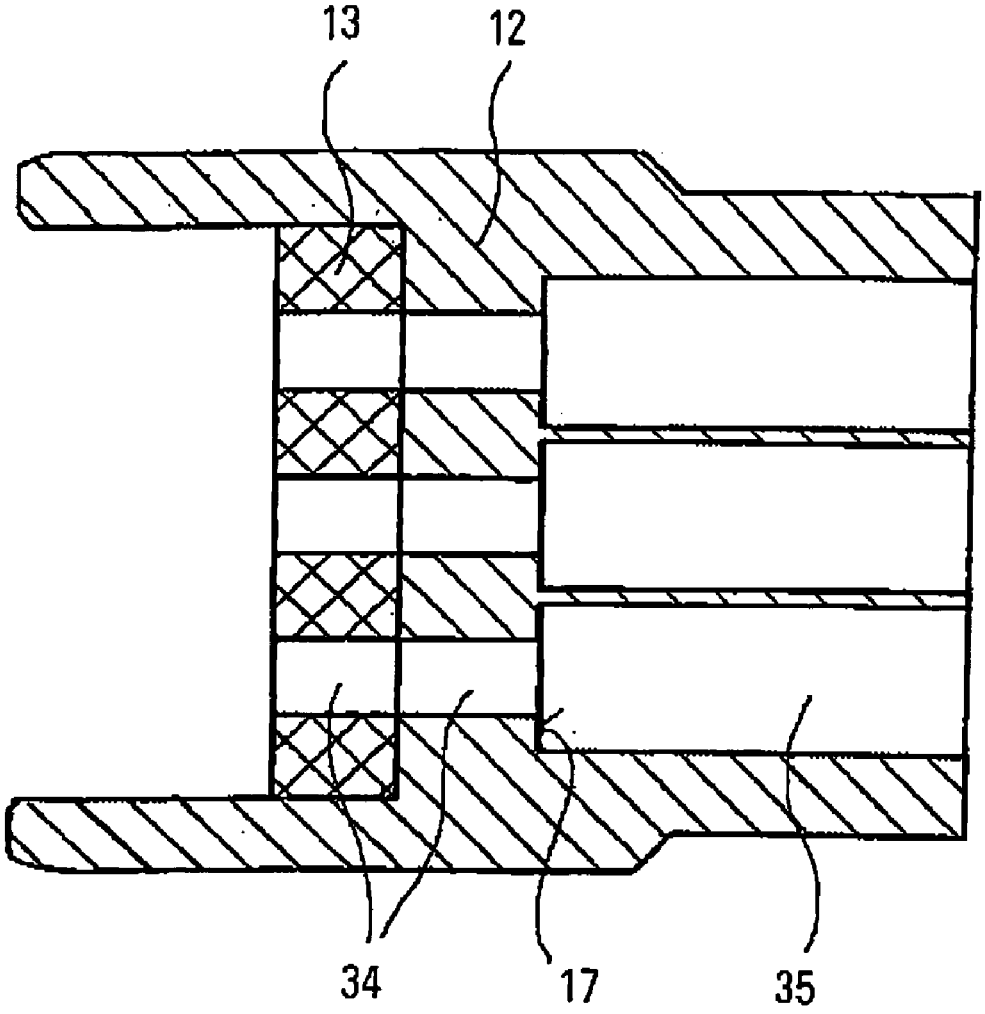
FIG. 4 is a sectional view showing the guide body and the slide seal of a spring-loaded contact element that have been produced together in a two-component injection molding process.

FIG. 4 shows the guide body 12 of the contact element 4 together with the slide seal 13 which is arranged between the annular member of the guide body 12. The slide seal 13 and the guide body 12 comprise guides 34 for receiving the spring-loaded contact pins 5, the members of the guides 34 in the guide body 12 being in axial alignment with the members of the guides 34 in the slide seal 13. In the guide body 12, the guides 34 pass into a cylindrical opening 35, the openings having a larger diameter than guides 34 and extending up to the contact side. Due to the transition of the guide 34 into the opening 35, abutment surfaces 17 are formed on which the annularly surrounding abutment shoulders 16 of the spring-loaded contact pins 5 rest in the opened state. The diameter of the opening 35 is here chosen such that it is suited to accommodate the abutment shoulder 16 and the compression springs 6.

When two connector members 1, 2 with a screw type connection are joined, the external thread section 32 of the locking ring 31 is screwed into the internal thread 33 of the insulating body 22, so that the two connector members 1, 2 move towards one another in axial direction. In this process the contact surfaces 24 of the contact pins 21 of the flange socket will come into contact with the contact surfaces 14 of the spring-loaded contact pins 5 of the plug before the axial movement of the two connector members 1, 2, towards one another is terminated, e.g. by the front surface of the guide body 12 abutting on the insulating body 22. The spring-loaded contact pins 4 start to shift axially in the direction of the interior 9 of the plug housing 3 after contacting the contact surfaces 14, 24. The resilient force of the compression springs 6, which are supported on the holding plate 18, counteracts the axial movement towards the interior 9 via the abutment shoulders 16 of the spring-loaded contact pins 5. During further joining of the two connector members 1, 2, the abutment shoulder 16 lifts from the abutment surfaces 17 due to the axial movement. Also after an end position has been reached, the abutment shoulders 16 are still lifted from the abutment surfaces 17 in the joined state, whereby the contact surfaces 14 of the spring-loaded contact pins 5 at the front side are pressed by the restoring force of the compressions springs 6 onto the contact surfaces 24 of the contact pins 21. To ensure a reliable contact between the contact surfaces 14, 24, a minimum slide path of the spring-loaded contact pins 5 in the slide seal 13 of 1 mm is needed.

When two connector members 1, 2 with a bayonet lock are joined, the joining movement is by analogy with the spring-loaded contact connectors having a screw type connection. When the end position is reached, the connector members 1, 2 are rotated radially between 5° and 230° relative to one another, whereby the locking pins 28 of the bayonet ring 23 move in the bayonet tracks 15 of the guide body 12 into an arrested position. During this rotational movement a frictional movement is created between the contact surfaces 14, 24 resting on one another under pressure, the frictional movement cleaning the contact surfaces 14, 24, thereby ensuring a high contact between the contact surfaces 14, 24 even in the case of small voltages and currents. Such a relative wiping movement between the contact surfaces 14, 24 can equally be realized in the case of a screw type connection.

The guide body 12 and slide seal 13 as shown in FIG. 4 are produced together in a two-component injection molding process. To this end, in a variable injection mold, the guide body 12 is first injected from an electrically insulating material, especially of polyamide, such as PA6. In a second step, the injection mold is changed, resulting in a cavity for the slide seal 13 at the plug side of the guide body 12. In a third step, a thermoplastic elastomer (TPE) is injected into said cavity. The TPE firmly adheres to the contact surfaces towards guide body 12. This yields a single component consisting of guide body 12 and slide seal 13, which is made from two materials, but has a joint aperture mask for receiving the spring-loaded contact pins 5. The slide seal 13 may here comprise sealing lips in the guide 34 for the spring-loaded contact pins 5, the sealing lips improving the sealing effect with respect to the spring-loaded contact pins 5 and being already formed during injection molding of the slide seal 13 through a corresponding design of the injection mold. Furthermore, the slide seal 13 in guide 34 may be provided with an oversize with respect to the spring-loaded contact pins 5, the oversize having a diameter which is about 10% smaller than that of the spring-loaded contact pins 5. In comparison with seals having sealing surfaces that are not movable relative to one another, the slide seal 13 is more sensitive to wear. That is why the slide path of the spring-loaded contact pins 5 in the slide seal 13 should be chosen to be as small as possible, but the minimum slide path must be observed for a safe contact transmission. The sealing effect of the slide seal 13 is designed for at least 50 plugging cycles—also for applications which only require a small number of joining operations or a one-time joining operation for the connector members 1, 2.

The invention claimed is:

1. A spring-loaded contact connector comprising two joinable connector members, at least a first connector member has a contact element and a plurality of spring-loaded contact pins that are supported in an axially displaceable manner in the contact element against a restoring force of a spring means, a second connector member having a plurality of contact surfaces that are brought into contact with contact surfaces of the contact pins of the first connector member when the first and second connector members are joined, the first connector member having a connection area for establishing a fixed electrical connection thereto, a compensating means for compensating for the axial displacement path of the spring-loaded contact pins when the connector members are joined, and a support plate on the contact element of the first connector member adjacent the connection area for supporting the spring means and through which the spring-loaded contact pins are guided in a relatively displaceable manner therewith.

2. The spring-loaded contact connector according to claim 1, wherein the compensating means includes a cavity in the first connector member and the spring-loaded contact pins are connected in the connection area to flexible connection lines that are movable in the cavity to thereby compensate for the axial displacement of the spring-loaded contact pins.

3. spring-loaded contact connector according to claim 1 or 2, wherein the spring-loaded contact pins are a rigid unit.

4. The spring-loaded contact connector according to claim 1, wherein the spring-loaded contact pins are one part.

5. The spring-loaded contact connector according to claim 1, wherein the spring-loaded contact pins are made from an electrically conductive material and have a corrosion-resistant surface coating.

6. The spring-loaded contact connector according to claim 1, wherein the connector members have guide means, said guide means being such that, when the connector members are joined, two opposite contact surfaces perform a relative wiping movement with respect to one another.

7. The spring-loaded contact connector according to claim 1, wherein the spring-loaded contact connector has a bayonet lock.

8. The spring-loaded contact connector according to claim 1, wherein the spring-loaded contact connector has a screw type connection.

9. The spring-loaded contact connector according to claim 1, wherein the spring-loaded contact pins are surrounded in portions by a seal which seals the spring-loaded contact pins relative to surroundings.

10. The spring-loaded contact connector of claim 1, wherein the spring means is a compression spring.

11. The spring-loaded contact connector according to claim 9, wherein the seal is watertight up to an overpressure of 1 bar.

12. The spring-loaded contact connector according to claim 9, wherein the seal is watertight up to an overpressure of more than 5 bar.

13. The spring-loaded contact connector according to claim 9, wherein the seal is a slide seal and the spring-loaded contact pins are guided in a relatively displaceable manner in the slide seal, so that the spring-loaded contact pins slide in a sealed fashion along the slide seal when the connector members are joined.

14. The spring-loaded contact connector according to claim 13, wherein the contact element and the slide seal are produced in a two-component injection molding process.

15. The spring-loaded contact connector according to claim 13 or 14, wherein the slide seal is made from a thermoplastic elastomer (TPE).

16. The spring-loaded contact connector according to claim 9, wherein the contact element is usable for both spring-loaded contact connectors with a bayonet lock and spring-loaded contact connectors with a screw type connection.

17. The spring-loaded contact connector of claim 5, wherein the spring-loaded contact pins are made from a copper-zinc alloy and the corrosion-resistant coating is of gold.

* * * * *